US007229250B2

(12) United States Patent
McCallum et al.

(10) Patent No.: US 7,229,250 B2
(45) Date of Patent: Jun. 12, 2007

(54) CONTROL SYSTEM FOR VARIABLE PITCH FAN

(75) Inventors: Jonathan E McCallum, Edmonton (CA); Andrew L Norell, St. Albert (CA)

(73) Assignee: Flexxaire Manufacturing Inc., Edmonton (CA)

( * ) Notice: Subject to any disclaimer, the term of this patent is extended or adjusted under 35 U.S.C. 154(b) by 194 days.

(21) Appl. No.: 10/970,095

(22) Filed: Oct. 20, 2004

(65) Prior Publication Data

US 2005/0100444 A1 May 12, 2005

Related U.S. Application Data

(60) Provisional application No. 60/512,080, filed on Oct. 20, 2003.

(51) Int. Cl.
*F04D 29/36* (2006.01)

(52) U.S. Cl. ..... 416/1; 123/41.49

(58) Field of Classification Search ..... 416/1
See application file for complete search history.

(56) References Cited

U.S. PATENT DOCUMENTS

| | | | | |
|---|---|---|---|---|
| 3,086,575 | A | 4/1963 | Nichols | |
| 3,501,251 | A | 3/1970 | Haglund et al. | |
| 3,560,108 | A | 2/1971 | Lindahl | |
| 3,588,272 | A * | 6/1971 | Lindahl et al. | 416/1 |
| 4,037,986 | A | 7/1977 | Chilman | |
| 4,221,541 | A | 9/1980 | Bianchi | |
| 4,461,340 | A | 7/1984 | Hart et al. | |
| 4,619,586 | A | 10/1986 | Carter | |
| 4,671,736 | A | 6/1987 | Finnigan | |
| 4,772,179 | A | 9/1988 | Bennett et al. | |
| 5,061,212 | A | 10/1991 | Marganthaler et al. | |
| 5,209,640 | A | 5/1993 | Moriya | |
| 5,284,418 | A | 2/1994 | Moriya | |
| 5,431,539 | A | 7/1995 | Carvalho | |
| 5,836,743 | A | 11/1998 | Carvalho et al. | |
| 6,109,871 | A | 8/2000 | Nelson et al. | |
| 6,113,351 | A | 9/2000 | McCallum et al. | |
| 6,126,079 | A | 10/2000 | Shoemaker | |
| 6,190,126 | B1 | 2/2001 | Haegele et al. | |
| 6,253,716 | B1 * | 7/2001 | Palmer et al. | 416/36 |

(Continued)

FOREIGN PATENT DOCUMENTS

| | | |
|---|---|---|
| CA | 2 243 151 A1 | 1/2000 |

(Continued)

OTHER PUBLICATIONS

U.S. Appl. No. 08/608,184, filed Feb. 28, 1996, Tischler.

(Continued)

*Primary Examiner*—Richard A. Edgar
(74) *Attorney, Agent, or Firm*—Christensen O'Connor Johnson Kindness PLLC

(57) ABSTRACT

Pitch control of a variable pitch fan is obtained using pulsed pressure. Pitch is varied incrementally either towards or away from full pitch by pulsed application of fluid to a piston used to drive the blades of the fan into or away from full pitch. Reverse pitch is used to clear debris from the fan. Valves control flow of fluid to the piston. The valve operation is controlled by a controller.

28 Claims, 7 Drawing Sheets

U.S. PATENT DOCUMENTS

| | | | | |
|---|---|---|---|---|
| 6,349,882 | B1 | 2/2002 | Kita et al. | |
| 6,439,850 | B1 | 8/2002 | McCallum et al. | |
| 6,644,922 | B2 | 11/2003 | McCallum et al. | |
| 6,729,844 | B2 * | 5/2004 | Bettencourt | 416/1 |
| 2004/0067135 | A1 | 4/2004 | McCallum et al. | |
| 2004/0151583 | A1 | 8/2004 | Bettencourt et al. | |

FOREIGN PATENT DOCUMENTS

| | | | |
|---|---|---|---|
| CA | 2 312 217 | A1 | 12/2000 |
| CA | 2 403 632 | A1 | 3/2004 |
| GB | 1 274 677 | | 5/1972 |
| GB | 2 022 534 | A | 7/1979 |
| WO | WO 99/20522 | A1 | 4/1999 |

OTHER PUBLICATIONS

*Isert Fan Thermostatic Pitch Controller Technical Manual*, T-J287A2.WP5(1.1), Trinity Electronics Systems Ltd., Alberta, Canada, Jul. 1990. Sales of the product described herein occurred in the United States at least as early as Apr. 1993.

Mc Callum, J., E-mail to US resident, Nov. 7, 2002.

Mc Callum, J., E-mail to US resident, Nov. 22, 2002.

"Flexxaire Engine Temperature Control Systems-F/X Fan Series," 01521(2), Flexxaire Manufacturing Inc., Aug. 23, 2000.

"Flexxaire Engine Temperature Control Systems-Operation & Maintenance Manual," 01508(2), Flexxaire Manufacturing Inc., Aug. 23, 2000, pp. 6-5 and 6-25.

* cited by examiner

CONTROL SYSTEM FOR VARIABLE PITCH FAN

CROSS-REFERENCE TO RELATED APPLICATIONS

This application claims the benefit of priority under 35 USC 119(e) of U.S. Provisional Patent Application No. 60/512,080 filed, Oct. 20, 2003.

BACKGROUND OF THE INVENTION

Flexxaire Manufacturing Inc. of Edmonton, Canada, manufactures a hydraulically controlled fan, and a pneumatically controlled fan. The pneumatic fan uses a single acting spring return piston, and the hydraulic fan uses a double acting piston. The current control systems for both fans have either two or three positions: full pitch and full reverse pitch, or full pitch, neutral and full reverse. A method of giving better control (partial pitch) is required. Both fans have similar difficulties, the force to pitch relationship has poor repeatability, high hysterisis, and is dependant on many variable factors (rpm, static pressure, blade length, and counterweight size). Both applications are cost sensitive.

SUMMARY OF THE INVENTION

According to an aspect of the invention, there is proposed a novel control system concept. The solution for both applications is to use a volume or pulsed control method instead of pressure regulation. Volume control using proportional or servo valves is too costly to achieve the level of control required: position control of the piston of 0.02 to 0.05 is desired (0.01 represents approximately 1 degree of pitch). For the hydraulic pitch control mechanism, this represents as little as 0.02 cc of oil. The solution is to use readily available (and cost effective) on-off solenoid valves. By controlling the duration of the ON time (controlled duration pulses), fluid can be metered to the piston, thereby controlling the pitch. The size of the step change is related to the response time of the valves. Valves are readily available (both hydraulic and pneumatic) that give pitch step changes as low as 1 degree or less.

Further summary of the invention is found in the claims, and discussed in the detailed description that follows.

DETAILED DESCRIPTION OF PREFERRED EMBODIMENTS OF THE INVENTION

The word comprising is used in its inclusive sense and does not exclude other elements being present. The indefinite article a preceding an element does not exclude more than one of the element being present. To purge is to reverse the pitch of the fan to blow debris off the radiator. Neutral pitch occurs when the blades are parallel to the plane of rotation. This is the pitch position of least drag (lowest horsepower consumption), and produces no airflow.

Figure 1:
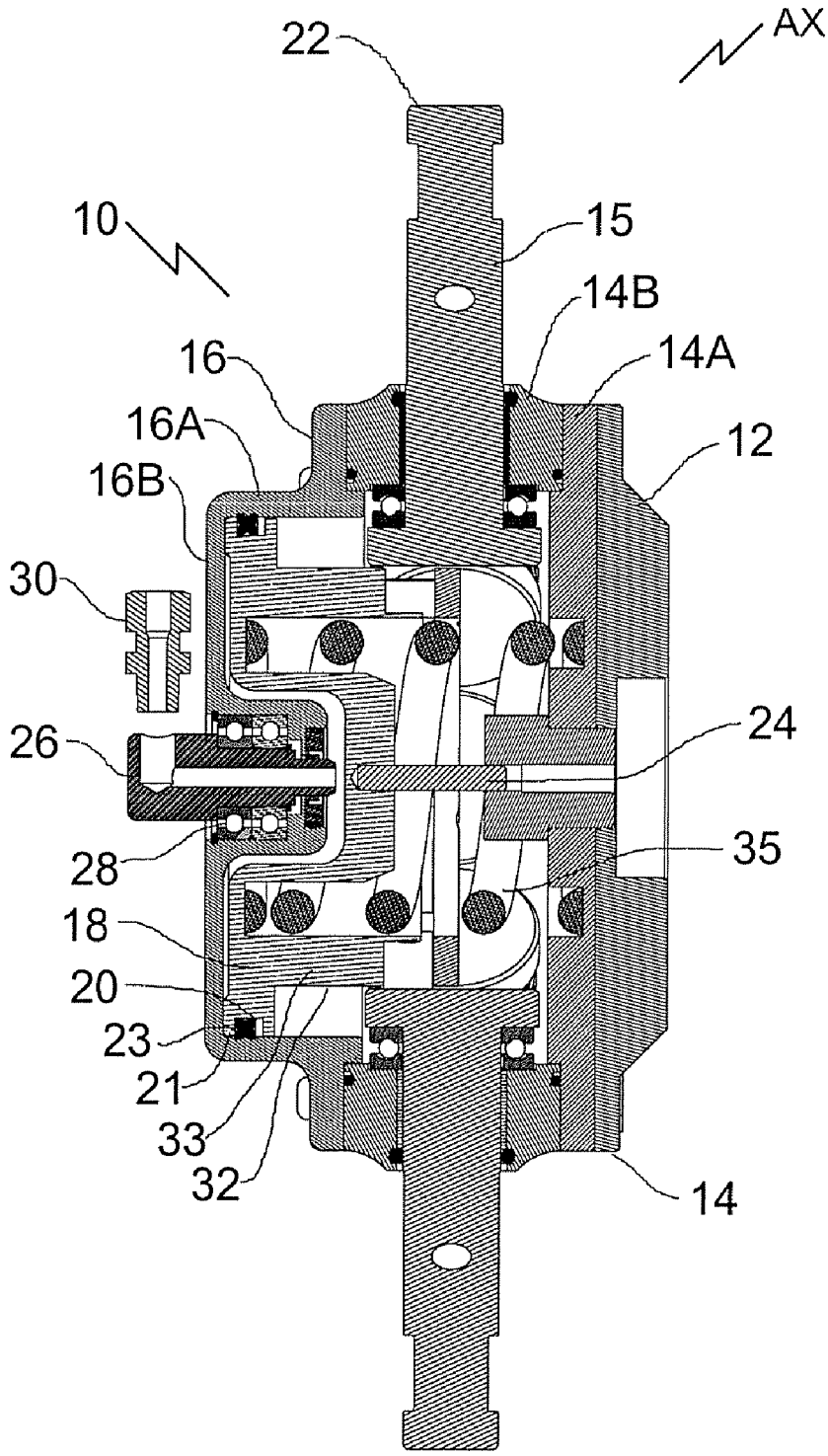
FIG. 1 shows a pneumatically controlled variable pitch fan.

Referring to FIG. 1, an exemplary pneumatically controlled variable pitch fan AX has a fan hub 10 formed of a mounting plate 12, a rear housing 14 and front housing 16. Rear housing 14 has a disc shaped end portion or back plate 14A to which the mounting plate 12 is attached, and a cylindrical portion 14B in which is formed circumferentially spaced openings for receiving blade mounts 15. Front housing 16 is secured to the rear housing 14 as for example by bolts to form a cylindrical hub cavity. The cylindrical hub cavity is bounded radially within the front housing 16 by a cylindrical wall 16A of the front housing 16, and axially by the end wall 14A and wall 16B of the front housing 16. The cylindrical hub cavity is bounded circumferentially by the wall 16A and an inner surface of the wall 14B, with the walls 16A and 14B together forming an encircling wall of the hub cavity.

A piston 18 is held within the hub cavity, with a sealed peripheral edge 21 of the piston 18 sealed against the encircling wall 16A using a seal 23 in seal groove 20. The piston 18 forms part of a pitch shifting mechanism for shifting the pitch of fan blades 22 mounted on the blade mounts 15. The piston 18 is stabilized within the fan hub 10 by contact of the outer peripheral sealed surface 21 of the piston with the encircling wall 16A and by a guide pin 24 that interconnects the piston 18 and the end wall 14A. The guide pin 24 preferably extends along the central axis of the fan hub 10 and is secured to the piston 18, while being able to slide through a central opening in the end wall 14A. The piston 18 is actuated by fluid, preferably air, injected through a port 26 lying on the axis of the fan hub 10. The port 26 is mounted on bearing 28 to allow rotation of the fan hub 10 while the port 26 remains stationary and connected through a line 30 to a supply of air, not shown. Preferably, to enhance stabilization of the piston 18, while maintaining a maximum cavity width, contact between the piston 18 and the encircling wall formed of walls 16A and 14B occurs at the outer peripheral sealed surface 21 and at an inner peripheral surface 32 on an annular extension 33 of the piston 18. The inner peripheral surface 32 of the piston 18 defines the maximum inner extent of the blade mounts 15, thereby maximizing blade length and piston surface while minimizing fan width. In operation, the inner peripheral surface 32 and the inner extent of the blade mounts 15 are provided with a small clearance of about 1/32 inches. Action of the piston 18 is opposed by a spring 35 held between end face 14A and end face 16B. Further details of the fan construction may be found in United States Patent Application No. 20040067135 published Apr. 8, 2004, the contents of which are hereby incorporated by reference.

The AX fan system does not include fan drive hardware. It is designed to mount onto an existing fan drive. The pitch control mechanism is the single acting, spring returned pneumatic piston 18. The piston 18 is approximately 5 in diameter and has a 1 inch stroke. The air line 30 attaches to the front of the fan AX via the integral rotary union 26. The small rotary union shaft 26 where the airline 30 attaches is the only non-rotating component on the fan AX. Although a large stiff spring is used, the pitch to pressure relationship is non-linear and non-repeatable with the exception of neutral pitch. Neutral pitch is repeatable. At a given pressure that is dependent on the fan construction, for example 35 psi, the fan will return to neutral pitch. Best results are achieved when you approach from the same side.

Figure 2:
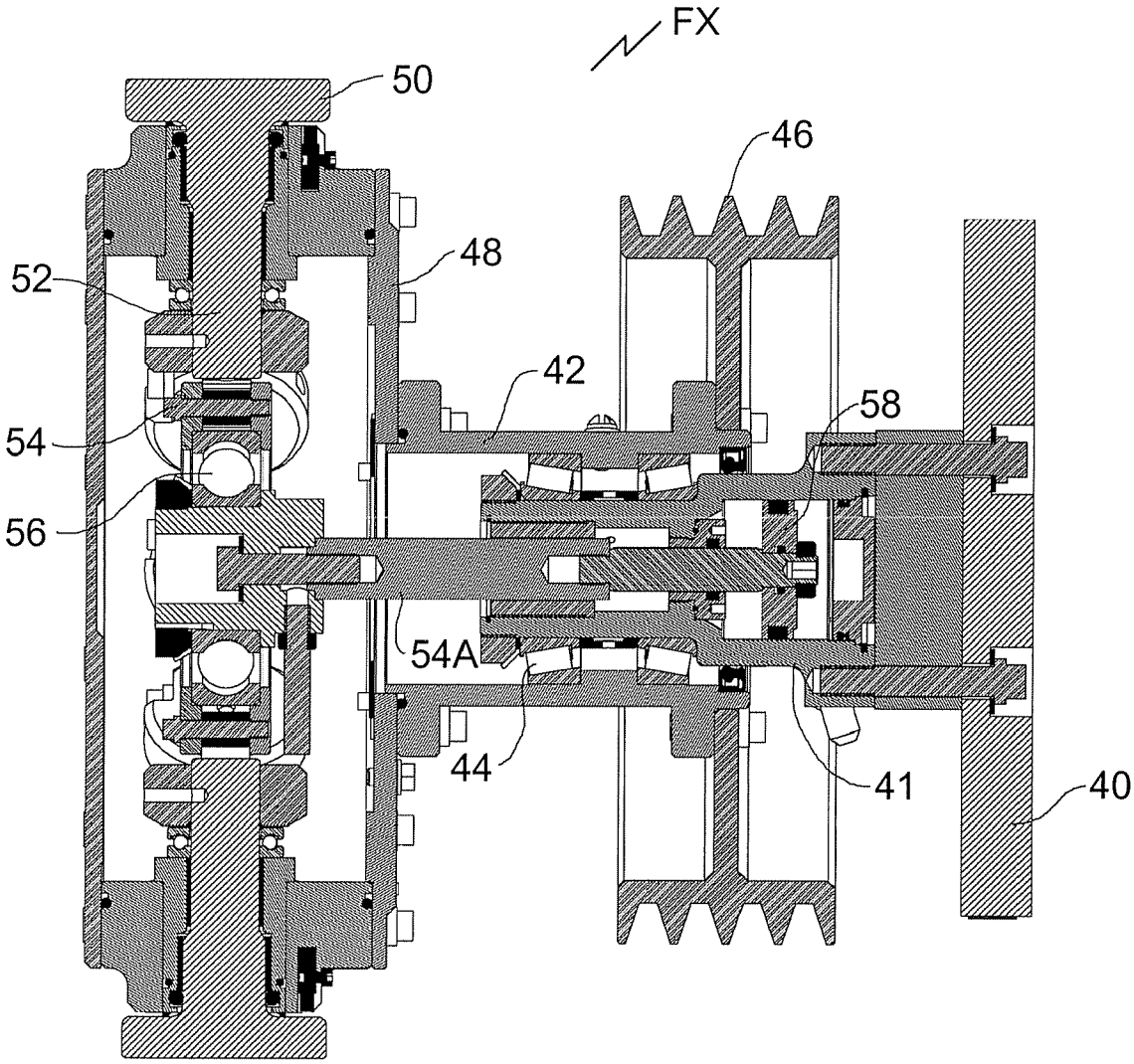
FIG. 2 shows a hydraulically controlled variable pitch fan.

Referring to FIG. 2, an exemplary hydraulically pitch controlled fan FX is shown. Mount 40 is fixed to the engine of a vehicle and main housing 42 rotates on bearings 44 on the shaft 41 supported on mount 40. Pulley hub 46 rotates the main housing 42. Blade hub 48 is connected to the main housing 42 and houses blades 50 mounted on blade shafts 52. A pitch shifter for the blades 50 is provided by a link 54 mounted on bearings 56 to allow the blade hub 48 to rotate around the pitch shifter. The link 54 rotates the blades 50 by converting back and forth movement of shaft 54A into rotation of the blades 50. Shaft 54A is activated by double acting piston 58. End positions of the double acting piston 58 correspond to full forward and full reverse pitch. The FX fan incorporates the fan drive (mount bracket 40, support shaft 41, pulley 46 and support bearings 44) with the variable pitch hub 48 and blades 50. The pitch control mechanism is the double acting hydraulic piston 58 that is built into the main support shaft 41. Two hydraulic lines are used to control the pitch. Pressuring one side increases the pitch in one direction, pressuring the other port increases pitch in the other direction. Piston diameters currently range from 1.44 to 2, and with strokes that range from 0.6 to 1. Due to centrifugal forces, the FX fan has a natural tendency to move to a neutral pitch (piston at mid stroke).

The pitch control system of the present invention is not limited to application to the two variable pitch fans described in some detail here but is applicable to any hydraulically or pneumatically controlled variable pitch fan. In either a hydraulically or pneumatically controlled fan, the pitch position may be varied by controlling the volume of fluid applied to a piston, such as piston 18 (FIG. 1) or the piston 58 (FIG. 2). An on-off solenoid valve may be used to control the volume of the control fluid.

The volume of control fluid may be controlled by a short duration pulse. By using short duration pulses (approximately 30 ms) small step changes can be made. This type of control lends itself very well to integral control where position feedback is not required. Integral control ignores the current pitch. The control system measures the current temperatures, compares them to the appropriate setpoints then either increase the pitch or decreases the pitch with a short pulse to the valves. After a short period of times, this loop is repeated. This type of control algorithm used with short duration pulses does not require a pitch sensor and results in a simple but robust and reactive full variable pitch system. In a variation of the short duration pulse, the length of the pulse can be related to the difference between the current temperature and the desired setpoint—i.e., the farther one is from the setpoint, the larger the pulse and therefore the larger the pitch step change. Alternatively multiple pulses could be used to achieve the larger pitch change (i.e., 3 consecutive pulses rather than one longer pulse) to achieve a large pitch change.

The control algorithm may also use a timed duration pulse. With this method, a timed pulse gives a tabulated pitch. By always starting a pitch adjustment from a known point, then turning the valve on for a predetermined length of time, discreet pitches are achieved. In the case of the pneumatic fan, for example: On any pitch move, first vent all the air. This puts the fan into full pitch. Then pulse the valve for 0.1 sec to get 25 degree pitch, or 0.2 seconds to get 15 degrees pitch etc. To re-adjust the pitch, first vent the air (fan returns to full pitch), then pulse the valve for the new duration. This method allows discrete pitch control without a pitch sensor, however it suffers from potential inaccuracies. First, the source pressure can typically vary from 90–120 psi. Therefore for similar duration pulse, a variation in volume can be expected. Second, valve reaction time may be inconsistent. Although most valves of a particular make and model are quite consistent, the response times can vary. Response time is the time it takes the valve to open or close when it is energized.

In a further example of volume control of fluid applied to control pitch of a variable pitch fan, a combination of timed duration pulses and short duration pulses may be used. A control algorithm can use a combination of the two methods. First, use a timed duration pulse to set the approximate pitch, then use the short pulses (in conjunction with an integral algorithm) to make fine pitch adjustments as the cooling load changes. This solves potential accuracy problems with the timed duration pulse. For example, this method assists with post purge recovery. After a purge cycle, typically one wants the fan to return to the pitch it was operating prior to the purge. Without a pitch sensor this becomes difficult. By using a timed duration pulse to recover the approximate pitch position, system equilibrium will be achieved more quickly than returning to either a full pitch or neutral pitch position. Also, at cold engine start up, a pulse duration that sets the fan at neutral pitch can be used when a machine is first started, rather than letting the control algorithm slowly move to neutral pitch.

Neutral pitch of a variable pitch fan provides a control reference point. In the case of the AX and FX fans, neutral pitch is readily found. Both the AX and FX fans are fully reversible. As the pitch mechanism strokes, the blades start in a full pitch position, the pitch decreases until neutral pitch is achieved, then the pitch increase to a full negative pitch. For controlling cooling loads/operating temperature, pitch is normally adjusted between full pitch and neutral. The only time reverse pitch is used is to blow debris off the radiator. Therefore it becomes important to know when neutral pitch is achieved, because further pitch adjustment starts increasing pitch (and airflow) rather than reducing pitch as expected.

Figure 3:
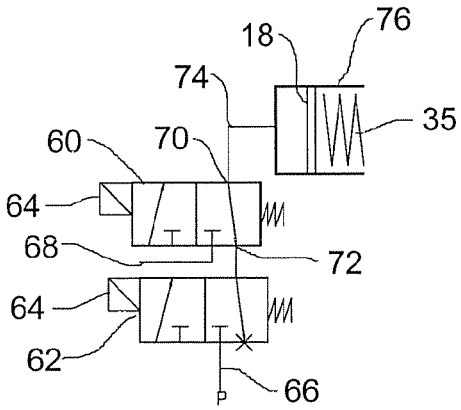
FIG. 3 shows an example of a control valve configuration for pneumatic pitch control.

Referring to FIGS. 3, 4, 5, 6, and 7, various valve configurations described here or later developed following the principles described here may be used for controlling the pitch of a pneumatically controlled variable pitch fan. In general, the valves used in the valve configurations should have low leakage and fast response for best results. Each valve 60, 62 is a three way two position valve including a solenoid 64, a pressure port 66 or exhaust port 68, and two ports 70, 72, each shown schematically in the figures in conventional fashion. Various valve configurations may be used, such as a two way two position valve, but a three way valve is a more common valve. In each example, port 70 is connected through a line 74 to supply air to the variable pitch fan 76. The pneumatic fan 76 uses a single acting, spring return piston 18. There is only one volume to control. The basic valve configuration shown in FIG. 3 is a valve 62 to add air, and a second valve 60 that removes (or vents) air. Pulsing one of the valves 60, 62 strokes the piston 18 to compress the spring 35, and pulsing the other of the valves 60, 62, vents the air allowing the piston 18 to return. The example shown in FIG. 3 is an open loop configuration using a simple valve configuration. To address the neutral pitch issue, a timed duration pulse method of control can be used (on any pitch move, always vent air first, then pulse the valve for a controlled duration, and ensure the duration does not put the fan past neutral pitch). It is well suited for fans that are mechanically limited to full pitch and neutral pitch (reverse pitch is not available) as there is no neutral pitch issue with this type of fan. Therefore, to increase pitch, the vent air solenoid valve 60 would be pulsed. To decrease pitch, the add air solenoid valve 62 would be pulsed. To purge the fan the add air solenoid valve 62 would be turned on for x seconds (user configurable), then the vent air solenoid would be turned on to vent the air.

Figure 4:
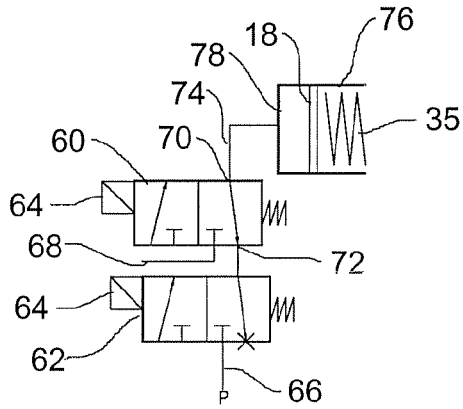
FIG. 4 shows another example of control valve configuration for pneumatic pitch control.

In FIG. 4, a closed loop option is provided using two valves, an add air valve 62 and a vent air valve 60 and a pitch sensor 78. This system uses the simplest valve configuration. The pitch sensor 78 addresses the neutral pitch issue, and also allows for discrete pitch setting. To increase pitch, the vent air solenoid valve 60 would be pulsed. To decrease pitch, the add air solenoid valve 62 would be pulsed. To purge the fan the add air solenoid valve 62 would be turned on for x seconds (user configurable), then the vent air solenoid valve 60 would be turned on to vent the air.

Figure 5:
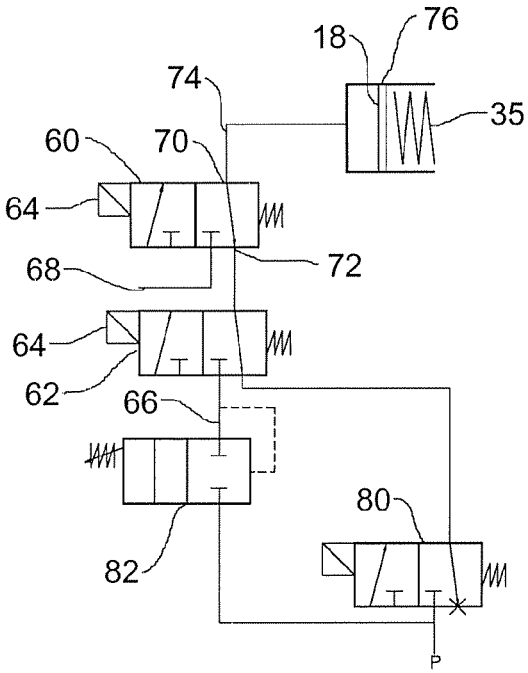
FIG. 5 shows another example of a control valve configuration for pneumatic pitch control.

In FIG. 5, a further open loop configuration is shown using two valves 60, 62, along with a third three way two position valve 80 and a regulator 82. This option uses one un-regulated add air solenoid valve 80, one regulated add air solenoid valve 62, and one vent air solenoid valve 60. The regulated add air solenoid valve 62 is regulated to the pressure corresponding to the neutral pitch, for example 35 psi. By regulating the pressure used by the temperature control circuit to 35 psi, neutral pitch will never be exceeded. Additional pulsing of the 35 psi add air solenoid valve will never exceed 35 psi. To increase pitch the vent air solenoid valve 60 would be pulsed. To decrease pitch, the regulated add air solenoid valve 62 would be pulsed. To purge the fan the un-regulated add air solenoid valve 80 would be turned on for x seconds (user configurable), then the vent air solenoid valve 60 would be turned on to vent the air.

Figure 6:
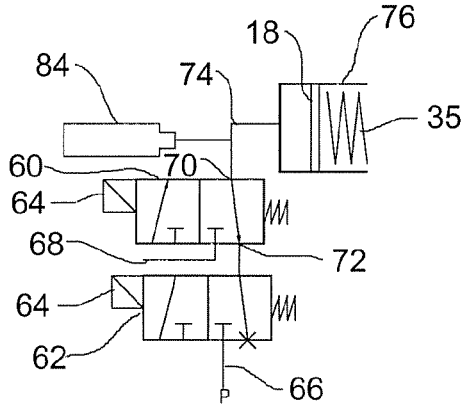
FIG. 6 shows another example of a control valve configuration for pneumatic pitch control.

In FIG. 6, a further two valve configuration is used using an add air valve 62 and a vent air valve 60 and a pressure sensor 84 on the line 74 leading to the fan 76. This system uses the simplest valve configuration. The controller (FIG. 12) monitors pressure in the control line 74 to the fan 76. Once 35 psi, or such other pressure that corresponds to neutral pitch as determined by the fan construction, particularly the spring constant, is reached, the control system would not pulse the add air solenoid valve 62 to reduce pitch, because the pitch is already at the minimum. To increase pitch, the vent air solenoid valve 60 would be pulsed. To decrease pitch, the add air solenoid valve 62 would be pulsed. Pulsing the add air solenoid valve 62 would only occur if the pressure to the fan was below the neutral pitch set point pressure. Pulsing this valve above the neutral pitch set point pressure will cause the fan to go into reverse pitch, which would increase airflow. To purge the fan the add air solenoid valve 62 is turned on for x seconds (user configurable), then the vent air solenoid valve 60 is turned on to vent the air.

Figure 8:
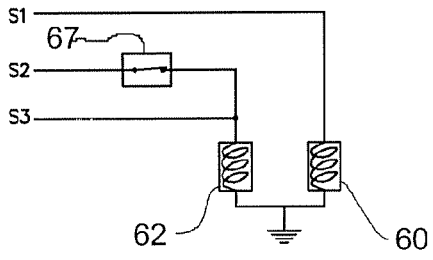
FIG. 8 shows an electrical schematic for the valve configuration of FIG. 7.
Figure 7:
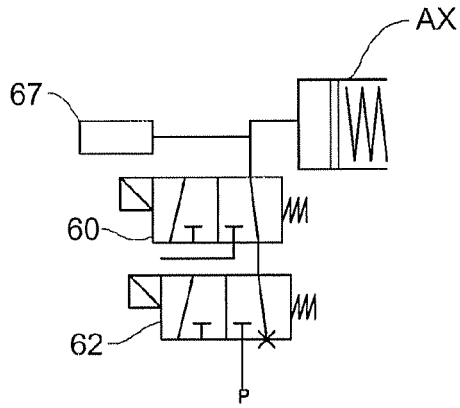
FIG. 7 shows another example of a control valve configuration for pneumatic pitch control.

Referring to FIG. 7, a further valve configuration is shown that is simpler than using a pressure sensor or device that requires feed back to the controller), but that still uses a simple valve setup. The valve configuration of FIG. 7 uses a pressure switch 67 rather than a sensor. Referring to FIG. 8, the one added complexity is that it requires an extra signal line S1 from the controller. Instead of needing two signal lines S2 and S3 (one for each valve 60, 62), it needs three signal lines: one line S1 for the increase pitch valve, and two lines S2 and S3 for the decrease pitch valve (one will decrease the pitch up to neutral). This valve configuration uses an add air valve 62 and vent air valve 60 and a normally closed pressure switch 67. The pressure switch 67 is selected such that it opens when the fan gets to neutral pitch, which is a fixed pressure for the AX fan. Control line S1 from the controller drives the vent air valve 60 and causes pitch increases, line S2 from the controller drives the add air valve 62 through the pressure switch 67 and cause pitch decreases up_to neutral pitch, and line S3 from the controller directly drives the add air valve 62 to reverse the pitch of the fan. Thus, to increase pitch, the vent air solenoid valve 60 would be pulsed by pulsing S1. To decrease pitch, signal line S2 would be pulsed. This will pulse the add air solenoid valve 62 as long as the pressure is below the pressure switch setting (ie neutral pitch). Once the pressure exceeds the neutral pitch setting, further pulsing of this valve would not occur. To purge the fan AX, signal line S3 would be turned on which would turn on the add air solenoid valve 62 for x seconds (user configurable), then the vent air solenoid valve 60 is turned on to vent the air.

Figure 9:
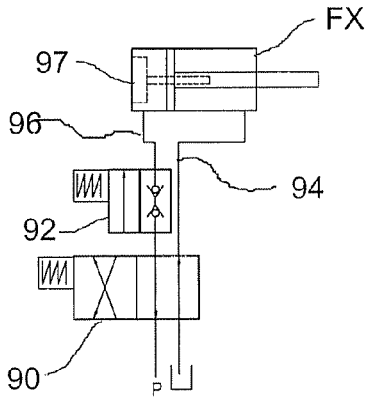
FIG. 9 shows an example of a control valve configuration for hydraulic pitch control.

The hydraulic fan (FIG. 2) uses a double acting piston 58. If the piston 58 is allowed to float, the fan will go to neutral pitch (mid stroke of the piston) due to the centrifugal forces acting on the blades. An example of a control system in this case is to use a directional valve system that is pulsed to add finite amounts of oil to stroke the piston 58 in small increments. The valve system needs to have close to zero internal leakage to minimize pitch drift. A simple method of achieving this with off the shelf components is to use a spool type directional valve 90 with a blocking valve 92 on one or both of the control lines 94, 96 of fan FX as shown in FIG. 9. The blocking valve 92 is almost zero leak, and has fast response time. If only one blocking valve is used, one direction of movement is not controllable, the move from reverse pitch to neutral (a vacuum forms, but does not stop the piston from moving). The three other directions are controllable (neutral to full pitch, full pitch to neutral, neutral to reverse pitch).

Figure 10:
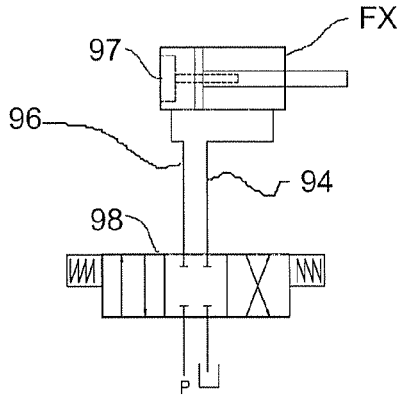
FIG. 10 shows another example of a control valve configuration for hydraulic pitch control.

Examples are shown in FIGS. 9 and 10 of control circuits for a hydraulic variable pitch fan FX using a directional hydraulic valve. The hydraulic valve may be a low leakage 4 way 3 position directional valve 98 with a closed center (FIG. 10), or may be a 4 way 2 position directional spool valve 90 (relatively high leakage) with a blocking valve 92 on one of the control lines 94 or 96 (FIG. 9). When using the blocking valve configuration, the directional valve 90 sets the direction, and the blocking valve 92 meters the fluid. Moves in both directions are forced moves. The neutral pitch issue is solved by using timed duration pulse method of control. A pitch positioning move always starts from a known reference (i.e., full pitch). A pitch sensor 97 may be used to determine pitch position. The neutral pitch issue is solved by feedback from the pitch sensor 97.

Figure 11:
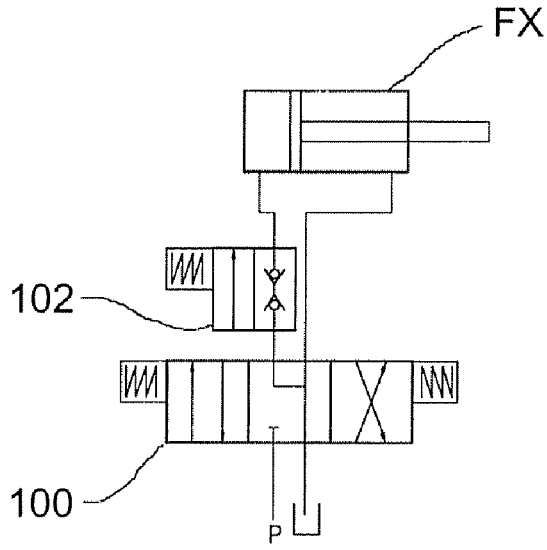
FIG. 11 shows another example of a control valve configuration for hydraulic pitch control.

As shown in FIG. 11, a hydraulic control circuit for a hydraulic variable pitch fan FX may use a 4 way-3 position directional hydraulic valve 100 with motor spool center position and a blocking valve 102. This design uses the normal tendency of the fan FX to return to neutral pitch from centrifugal force. To increase pitch, the directional solenoid valve 100 will be turned on in the increase direction, and the blocking solenoid valve 102 will be pulsed. To decrease pitch, the directional solenoid valve 100 will be turned off (motor spool center position), and the blocking valve 102 will be pulsed. Centrifugal force will bring the fan back to neutral pitch. Further pulsing of the blocking valve 102 once neutral is reached will not affect the pitch. To purge the fan FX, the blocking valve 102 will be turned on, and the directional solenoid valve 100 will put the fan FX in to full reverse then full forward pitch.

Figure 12:
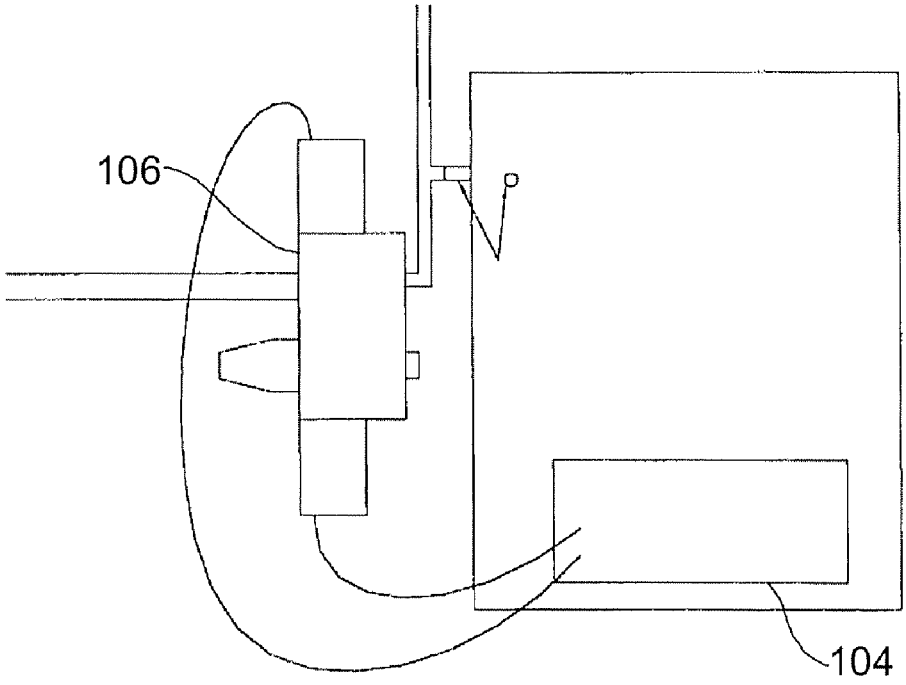
FIG. 12 is a schematic showing the relationship of controller, control valve and fan.

Referring to FIG. 12, an electronic controller 104 is needed to control the valves of the control system exemplified by valve 106 in the figure. The valves could be any of the configurations shown in FIGS. 3–6 and 9–11, or other suitable valves to achieve the pulsed control of fluid to the variable pitch fan in accordance with the principles of the invention as described here. This can be a dedicated electronic device, or a virtual device: an existing programmable controller can be programmed to directly control the valves (i.e., the ECM-engine control module). There are a number of parameters that affect the cooling requirements of a machine, and therefore the required pitch of the fan AX or FX. The types and numbers of parameters vary from machine to machine depending on which systems are cooled by the fan (i.e., Air conditioner condenser, hydraulic oil cooler, air to air after cooler, engine coolant, etc.). Some machines have ECM's (electronic control modules) that already measure all of these parameters and this information can be tapped into. Some machines have fan speed outputs to control the speed of variable speed fans. This output takes into account all the appropriate parameters. Because of the variety, different types of control can be used.

There are a variety of inputs that can be used for the controller 104. These can be used individually, or in conjunction with each other, for example: A. The input may be an analog input such as temperature sensors (these are sensors that would be used exclusively by the fan control—i.e., they need to be installed with the control system) that could measure for example intake air temperature, coolant temperature, etc, pressure sensors (these are sensors that would be used exclusively by the fan control—i.e., they need to be installed with the control system), air pressure in fan control line or AC condenser core pressure. B. The input may be a control signal such as a PWM fan drive signal. Many engine manufacturers have programmed a PWM fan speed signal that is used on many hydraulic fan drives. This may be used to control the pitch by using an algorithm that converts this proportional signal to an integral signal—for example use a setpoint of 80% of fan speed. If you are below that, increase pitch, if you are above, decrease pitch. C. The input may be a digital input such as from temperature switches instead of temperature sensors, AC compressor input—a digital signal that indicates the AC compressor is running, a backup alarm input (to suppress purges), a fire suppression input, an operator input such as manual purge button, or ECM/Can bus inputs. ECM/Can bus inputs form a communication link. This allows data to be shared from other electronic devices eliminating the requirement for redundant sensors. For example, most ECM's monitor engine temperature. By connecting to the ECM, the control system would not need its own dedicated engine temperature sensor. Other digital inputs include a J1939 Can interface (or the diagnostic port) to capture sensor data, a direct ECM interface, other controllers existing on the equipment on which the fan is used, an IQAN hydraulic controller, or a transmission controller.

The outputs of the controller may include 2 or 3 digital solenoid driver outputs (depending on the valve configuration) and an optional digital output to indicate when the fan is purging (i.e., connect a dash light to the controller). The controller can either be a virtual device (a program running on an existing programmable controller) or a dedicated electronic device. It will determine the pitch requirements by looking at sensor data. The sensor data may be obtained directly by the controller, or may be communicated to the controller by another electronic device. The controller will then adjust the pitch of the fan by pulsing the appropriate valves. Variations of the control system will be applicable to some machines where as other variations will be applicable to others: Large OEMS (for example Caterpillar) will use the virtual controller to save cost and complexity, where as smaller OEM's may not have the capability to reprogram an engine ECM, and will therefore require a separate device.

Figure 13:
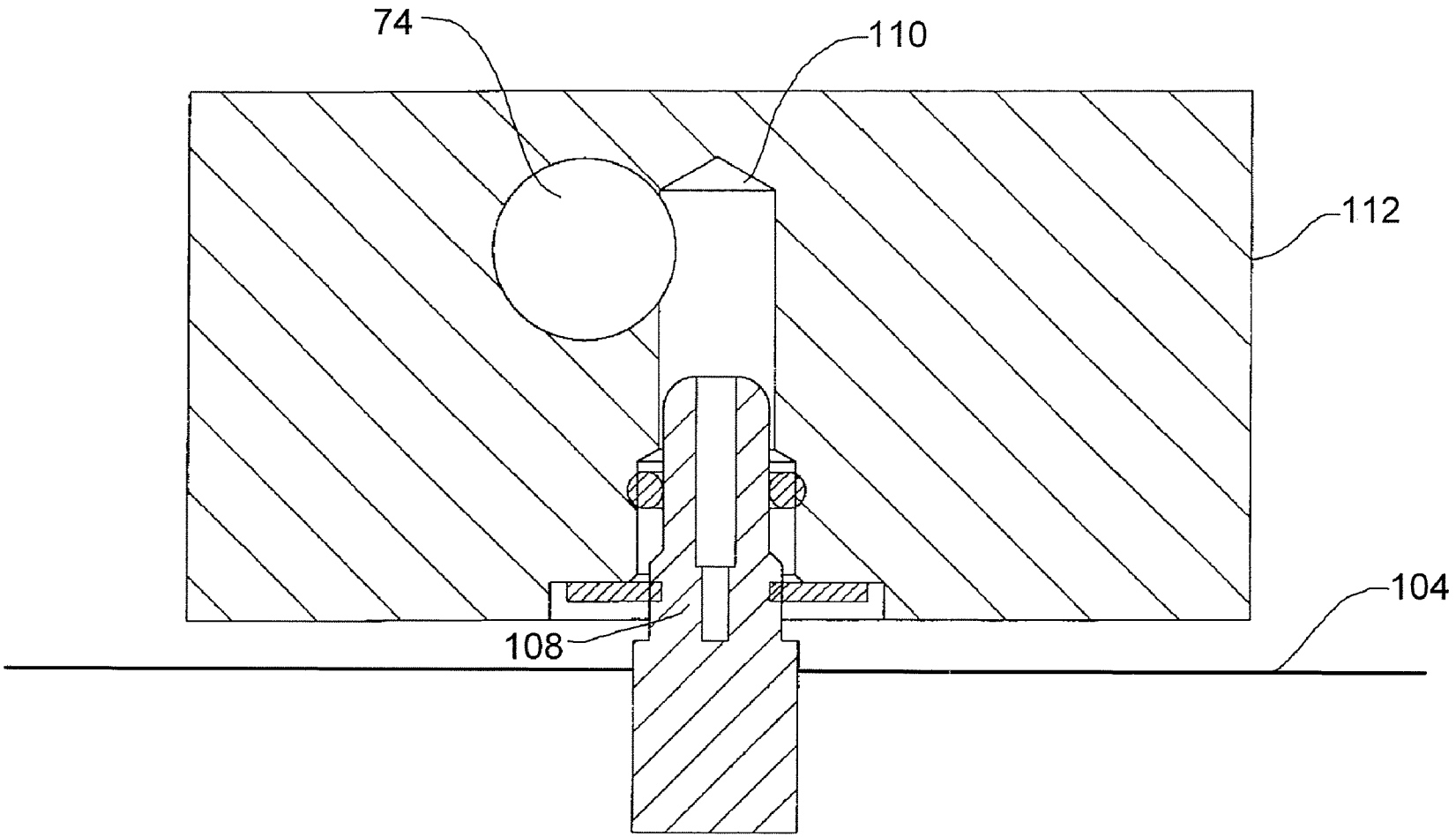
FIG. 13 is a schematic showing an arrangement for readily sensing pressure in a variable pitch fan fluid supply.

Referring to FIG. 13, a pressure sensor 108 may be constructed to protrude from the controller 104. This may then be inserted directly into the fluid flow line (such as line 74 in FIG. 3) for measurement of the pressure being applied to the piston of the fan in a recess 110 made in a housing 112 that contains the flow line 74.

Figure 14:
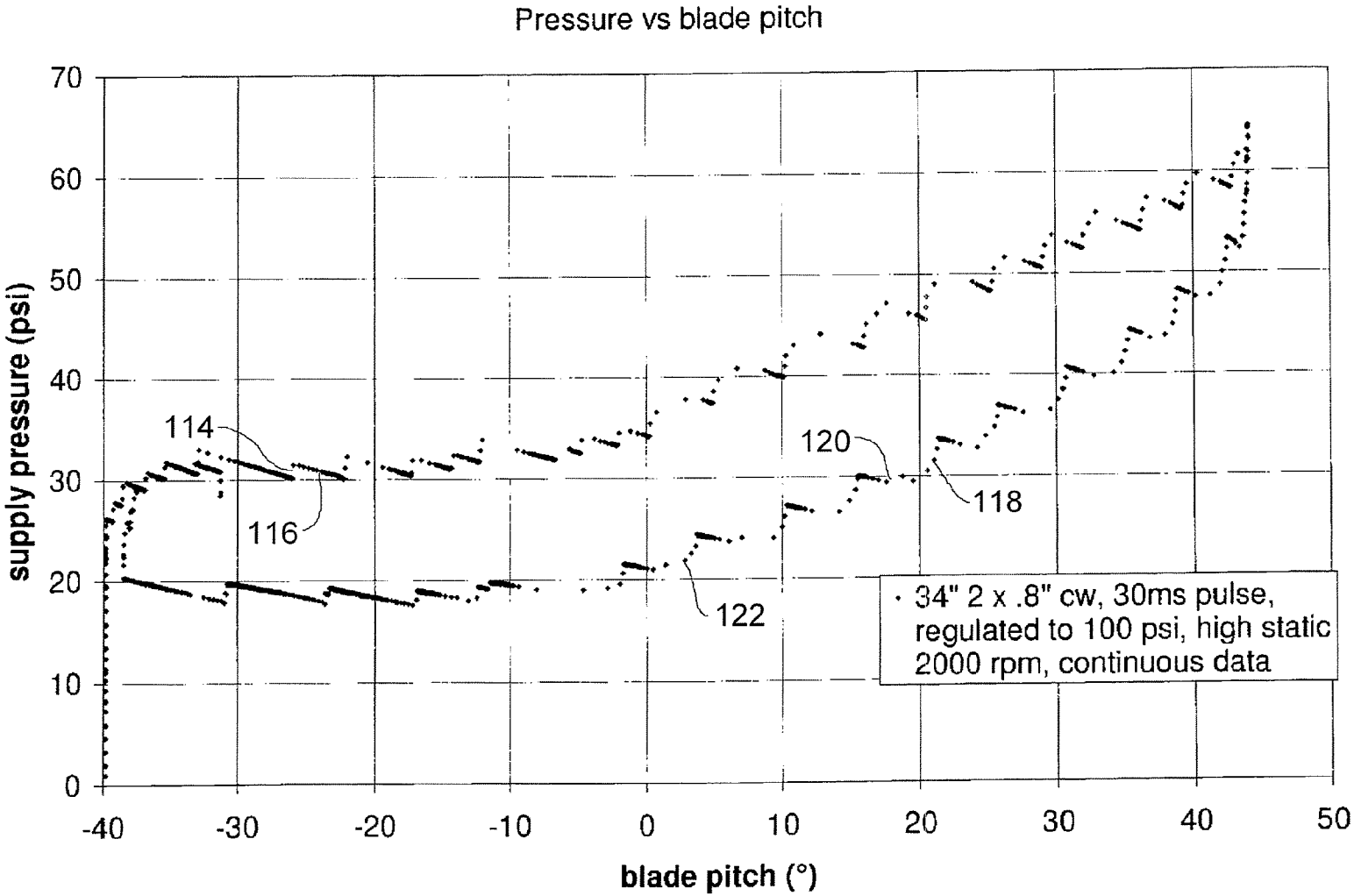
FIG. 14 shows an example of the relationship between control fluid pressure verses blade pitch for operation of a variable pitch fan.

FIG. 14 shows the hysteresis operation of the control system. Initially the fan is at full pitch (−40 degrees). As the control valve 106 is pulsed to pulse the flow line with pressure, pressure initially rises quickly at 114 as pressure from the pressure source flows into the flow line 74. As the piston 18 begins to move, the pressure slowly drops as shown at 116. This process is repeated until engine operating parameters indicate that the fan blades have changed pitch a sufficient amount to cause a monitored parameter to change in a desired direction. An example would be an increase in engine temperature. As the flow line is charged with air, the fan pitch changes slowly and the pressure begins to rise until the fan is in reverse pitch. Thereafter, pulsed release of air results in a quick drop in pressure 118 followed by a slow rise 120 as the spring 35 urges the piston 18 back into full pitch position. A different path 122 is followed by the system on the return path due to friction and other hysteresis effects.

Immaterial modifications may be made to the examples described here without departing from the invention.

What is claimed is:

1. A variable pitch fan control system, comprising:

a variable pitch mechanism, the variable pitch mechanism being operated by control fluid;

a control fluid line leading to the variable pitch mechanism;

a valve assembly on the control fluid line that is responsive to pulsed control signals to control the volume of fluid in the control fluid line; and a controller responsive to an input to provide pulsed control signals to the valve assembly.

2. The variable pitch fan control system of claim 1 in which the pulsed flow of fluid provides integral control of the variable pitch mechanism.

3. The variable pitch fan control system of claim 1 in which the controller provides pulsed control signals to generate variable length pulses of control fluid, where the length of the pulses is dependent on the difference between a measured parameter and a desired set point.

4. The variable pitch fan control system of claim 1 in which the valve assembly comprises a vent valve and an add valve.

5. The variable pitch fan control system of claim 1 in which pulsed control signals to the valve assembly are regulated by a pressure switch.

6. The variable pitch fan control system of claim 5 in which the pressure switch is responsive to pressure on the control fluid line.

7. The variable pitch fan control system of claim 1 in which the controller is responsive to input from a sensor of pressure of pulsed control fluid provided to the variable pitch mechanism.

8. The variable pitch fan control system of claim 1 in which:

the variable pitch mechanism incorporates a double acting piston;

the control fluid line comprises first and second lines leading to opposed sides of the double acting piston; and the valve assembly comprises a directional valve and a blocking valve, the blocking valve being located on one of the first and second lines, and the directional valve being operable to supply fluid to the first and second lines under control of the controller.

9. The variable pitch fan control system of claim 7 in which:

the control fluid line is incorporated at least partly within a housing;

the housing has a recess communicating with the control fluid line; and the pressure sensor extends directly from the controller into the recess.

10. The variable pitch fan control system of claim 1 in which the variable pitch mechanism is a hydraulic mechanism.

11. The variable pitch fan control system of claim 8 in which the variable pitch mechanism tends to move towards neutral pitch in the absence of control fluid pulses.

12. The variable pitch fan control system of claim 1 in which the variable pitch mechanism is a pneumatic mechanism.

13. The variable pitch fan control system of claim 12 in which the variable pitch mechanism is balanced by a spring and neutral pitch is obtained at a fixed pressure.

14. The variable pitch fan control system of claim 1 in which the valve assembly comprises on-off solenoid valves.

15. A method controlling fan pitch of a variable pitch fan system, the method comprising the steps of:

supplying a flow of fluid to a variable pitch mechanism to cause fan pitch change; and controlling the volume of fluid by pulsing a valve assembly to cause incremental changes of fan pitch.

16. The method of claim 15 in which controlling of the volume of fluid is carried out depending on difference of a measured parameter from a desired set point.

17. The method of claim 15 in which the controlling of the volume of fluid is dependent on pressure of fluid supplied to the variable pitch mechanism.

18. The method of claim 15 in which the controlling of the volume of fluid is temperature dependent.

19. The method of claim 15 in which the controlling of the volume of fluid provides integral control of the variable pitch mechanism.

20. The method of claim 15 in which the valve assembly is pulsed to provide variable length pulses of control fluid, where the length or number of the pulses is dependent on the difference between a measured parameter and a desired set point.

21. The method of claim 15 in which the controlling of the volume of fluid is regulated by a pressure switch.

22. The method of claim 21 in which the pressure switch is responsive to pressure on the control fluid line.

23. The method of claim 15 in which the controlling of the volume of fluid is controlled by a controller that is responsive to input from a sensor of pressure of control fluid provided to the variable pitch mechanism.

24. A variable pitch fan control system, for use with a variable pitch fan having a variable pitch mechanism operated by control fluid, the variable pitch fan control system comprising:

a control fluid line for delivering control fluid to the variable pitch mechanism;

a valve assembly on the control fluid line that is responsive to pulsed control signals to control the volume of fluid in the control fluid line; and a controller responsive to an input to provide pulsed control signals to the valve assembly.

25. The variable pitch fan control system of claim 24 in which the controller provides pulsed control signals to generate variable length pulses of control fluid, where the length of the pulses is dependent on the difference between a measured parameter and a desired set point.

26. The variable pitch fan control system of claim 24 in which:

the variable pitch mechanism incorporates a double acting piston;

the control fluid line comprises first and second lines leading to opposed sides of the double acting piston; and the valve assembly comprises a directional valve and a blocking valve, the blocking valve being located on one of the first and second lines, and the directional valve being operable to supply fluid to the first and second lines under control of the controller.

27. The variable pitch fan control system of claim 24 in which:

the controller is responsive to input from a pressure sensor;

the control fluid line is incorporated at least partly within a housing;

the housing has a recess communicating with the control fluid line; and the pressure sensor extends directly from the controller into the recess.

28. The variable pitch fan control system of claim 24 in which the valve assembly comprises on-off solenoid valves.

* * * * *